United States Patent [19]

Cottrell

[11] 4,271,978

[45] Jun. 9, 1981

[54] STICK DISPENSER

[75] Inventor: Edward D. Cottrell, Cattaraugus, N.Y.

[73] Assignee: Champion International Corporation, Stamford, Conn.

[21] Appl. No.: 44,110

[22] Filed: May 31, 1979

[51] Int. Cl.[3] ..... B65H 3/44

[52] U.S. Cl. ..... 221/243; 221/252; 221/264

[58] Field of Search ..... 221/243, 252, 263, 264, 221/93, 94, 68; 133/4 R, 4 A

[56] References Cited

U.S. PATENT DOCUMENTS

| | | | |
|---|---|---|---|
| 2,434,257 | 1/1948 | Burch | 221/264 X |
| 3,132,765 | 5/1964 | Florendo | 221/263 X |
| 4,010,765 | 3/1977 | Clay | 133/4 A |

*Primary Examiner*—F. J. Bartuska
*Attorney, Agent, or Firm*—Evelyn M. Sommer

[57] ABSTRACT

Apparatus for simultaneously feeding a plurality of sticks to a confectionary mold. The sticks are fed from a storage hopper through spaced openings provided in a fixed bottom plate. A reciprocating plate slidable on the bottom plate within the hopper includes a plurality of openings adapted to be placed in registration with the openings in the bottom plate to dispense the sticks. Should a stick become clogged in an opening, the remaining openings can still be placed in registration to dispense sticks. This is accomplished by dividing the reciprocable, sliding plate into a plurality of sections which are spaced from each other by the dispensing openings in the plate. Side bars connect the sections so they can move as an integral unit. Each section however, has a first and second spring-connected portion. Each portion can move independently of and relative to another so that if a dispensing opening between sections is clogged, the remaining openings in the reciprocable plate and fixed plate may still be placed in registration through movement transmitted by the side bars to the remaining sections of the reciprocable plate while the portions of the section in contact with the clogged stick are contracted towards each other.

15 Claims, 11 Drawing Figures

STICK DISPENSER

BACKGROUND OF THE INVENTION

1. Field of the Invention

This invention relates to stick feeding apparatus, and more particularly, to a stick feeding apparatus for delivering a plurality of sticks simultaneously to predetermined positions in a confectionary mold at a controlled rate.

2. Description of the Prior Art

In the manufacture of stick-mounted confectionary food products, such as lollipops, large numbers of sticks must be delivered rapidly to product-holding molds.

Because manual insertion of sticks requires far too much time and labor, both of which lead to increased product costs, stick feeding apparatus have been developed in an effort to automate the delivery of such sticks. Examples of such apparatus are disclosed in my prior U.S. patent application Ser. No. 913,532 filed June 8, 1978 now U.S. Pat. No. 4,209,112, entitled STICK FEEDING APPARATUS and U.S. patent application Ser. No. 823,621 filed Aug. 11, 1977, entitled STICK HANDLING AND INSERTING METHOD AND APPARATUS, now U.S. Pat. No. 4,130,936 issued Dec. 26, 1978, and the patents cited and discussed therein.

One problem with known stick feeding apparatus is that such apparatus cannot be relied upon to consistently deliver sticks simultaneously to each mold in a large array of product-holding molds. Of course, if a stick is not delivered to a mold when it is supposed to be, the use of that mold is lost for at least one production cycle and product materials may be wasted. Moreover, the entire manufacturing process may be slowed since a defective product may have to be manually extracted from the mold while acceptable products may be automatically extracted. Further, should one of the dispensing elements in the stick feeding apparatus jam or become inoperative because of a clogged stick, this has usually caused the entire appparatus to be shutdown, thereby losing valuable production time as well as causing waste of product materials delivered to the mold during the production cycle.

As indicated above, it is important that a plurality of sticks be delivered simultaneously to the product-holding molds. At the very least, should a portion of the stick delivery apparatus be rendered ineffective or inoperative due to clogging or jamming at a stick dispensing opening, the remaining sticks during any one production cycle should be delivered.

Another problem encountered with prior art apparatus is that if the apparatus is adjusted to assure that a stick is delivered to each desired position, there is a chance that more than one stick will be delivered to a position during each cycle. This is not only wasteful of sticks, but may also lead to an interruption in the manufacturing process as the unneeded stick is manually removed from the mold.

SUMMARY OF THE INVENTION

The present invention is a low cost stick feeding apparatus for delivering a plurality of sticks simultaneously to a predetermined position at a controlled rate. Should one stick dispening orifice become clogged, jammed or inoperative, the remaining portions of the apparatus remain operative to delivery sticks to at least some of the predetermined mold positions. Finally, the apparatus assures that only one stick is dispensed to each predetermined location or mold site.

The apparatus includes a hopper provided with a fixed bottom plate containing a number of elongated stick dispensing openings spaced along a horizontal surface of the plate. A movable plate assembly is reciprocably slidable on the fixed bottom plate by means of a pneumatic or hydraulically actuated plunger containing a cam surface which reciprocably drives a cam connected to the upper plate assembly to slide the upper plate assembly relative to the fixed plate assembly to place a plurality of openings in the upper plate assembly in registration with the elongated openings in the horizontal surface of the fixed bottom plate to dispense one stick at a time through each of the registered openings along the plate simultaneously to a product-containing mold disposed beneath the bottom plate.

The upper, sliding plate assembly consists of a plurality of horizontally disposed individual sections received within and movable with a rectangular framework including reciprocably slidable side bars operatively connected to the cam mechanism for reciprocably sliding the upper plate relative to the fixed lower plate to place the dispensing openings in the upper plate in registration with the openings in the bottom plate. Each individual section includes a pair of spring-connected first and second plate portions which are normally biased apart. One of the dispensing openings in the upper slidably reciprocable plate is disposed between each of the forward-most or first portions of each section of the upper plate and the rear-most or second plate portion of the next succeeding section. Accordingly, should a stick become jammed in one of the openings in the upper plate during operation of the apparatus, the rear-most portion of each upper plate section would be able to move towards the forward-most portion of each upper plate section against the bias of its spring connection upon movement of the side bars so as not to impede travel of the side bars and the remaining plate sections to assure registration of the remaining dispensing openings in the upper plate with the openings in the lower fixed plate.

A stop is placed above the path of movement of the upper plate assembly to enable only one stick received within each dispensing opening in the upper plate assembly to be conveyed to and placed in registration with the mating dispensing opening in the fixed bottom plate.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 2:
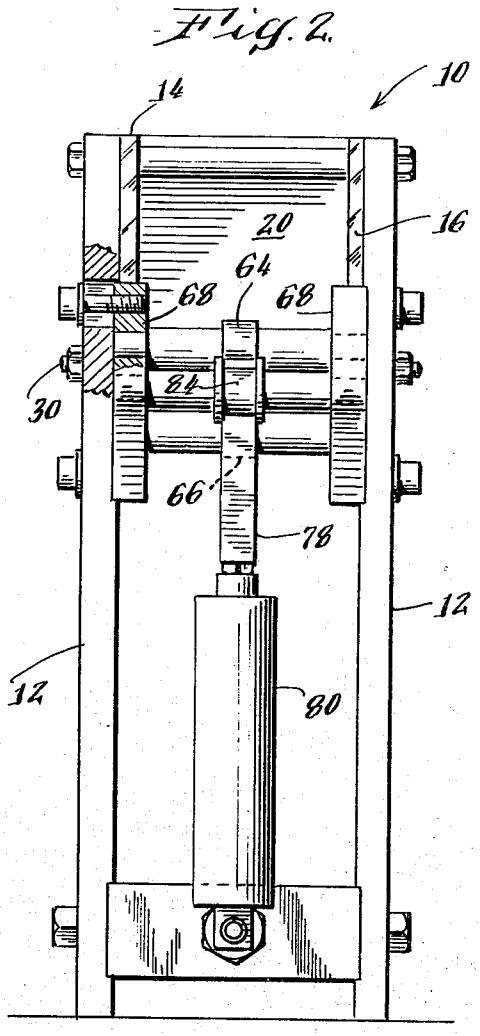
FIG. 2 is a side view in elevation of the stick dispensing apparatus of FIG. 1 as seen from the right hand side of FIG. 1.
Figure 1:
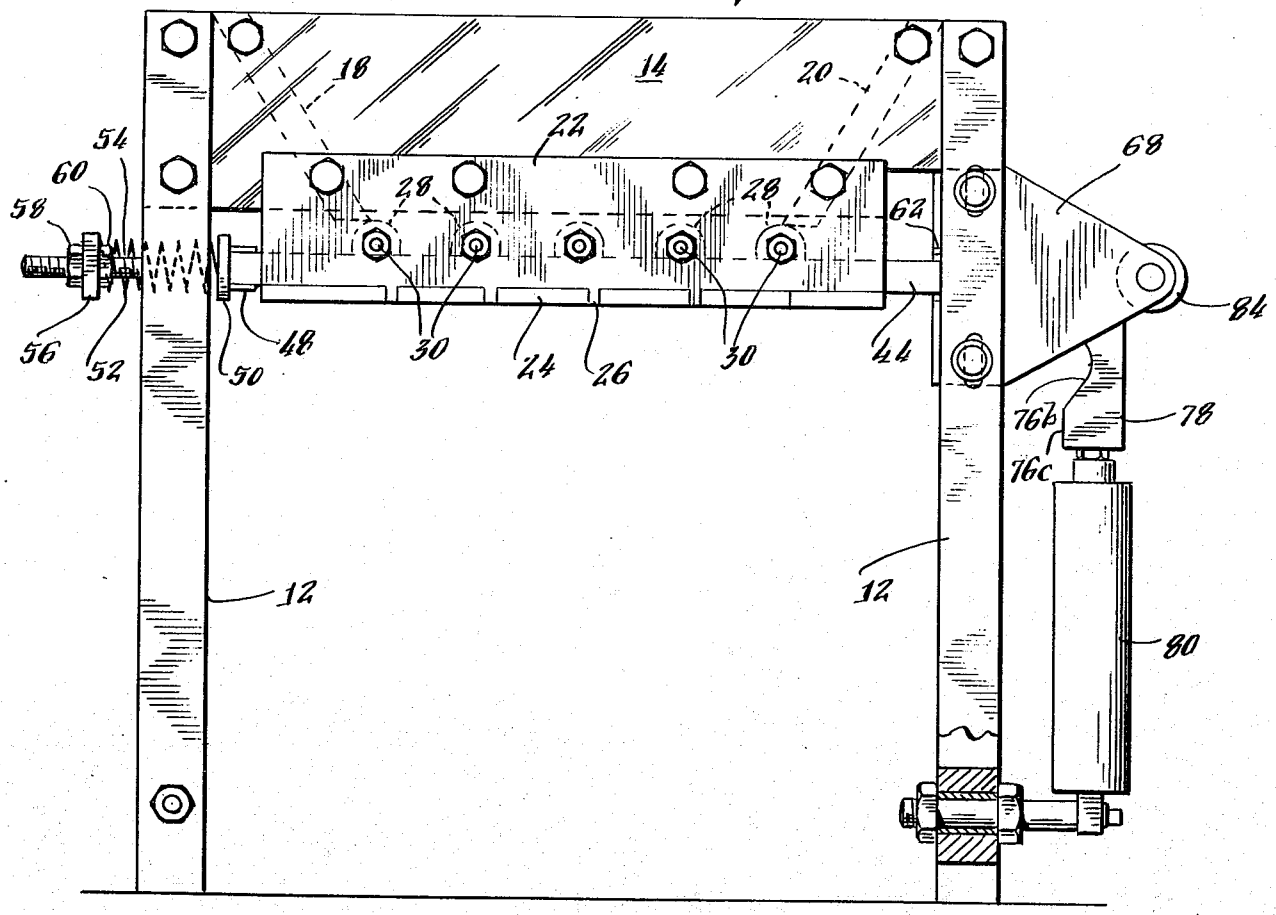
FIG. 1 is a front view in elevation of the stick dispensing apparatus of the present invention.

Referring now to the drawings in detail, wherein like numerals indicate like elements throughout the several views, the stick dispensing apparatus 10 of the present invention includes an upright framework 12 mounting spaced front and rear walls 14 and 16. The walls 14 and 16 can be made from clear plastic such as "Lucite" so that the interior of the apparatus 10 is open to view by the operator of the apparatus.

Figure 6:
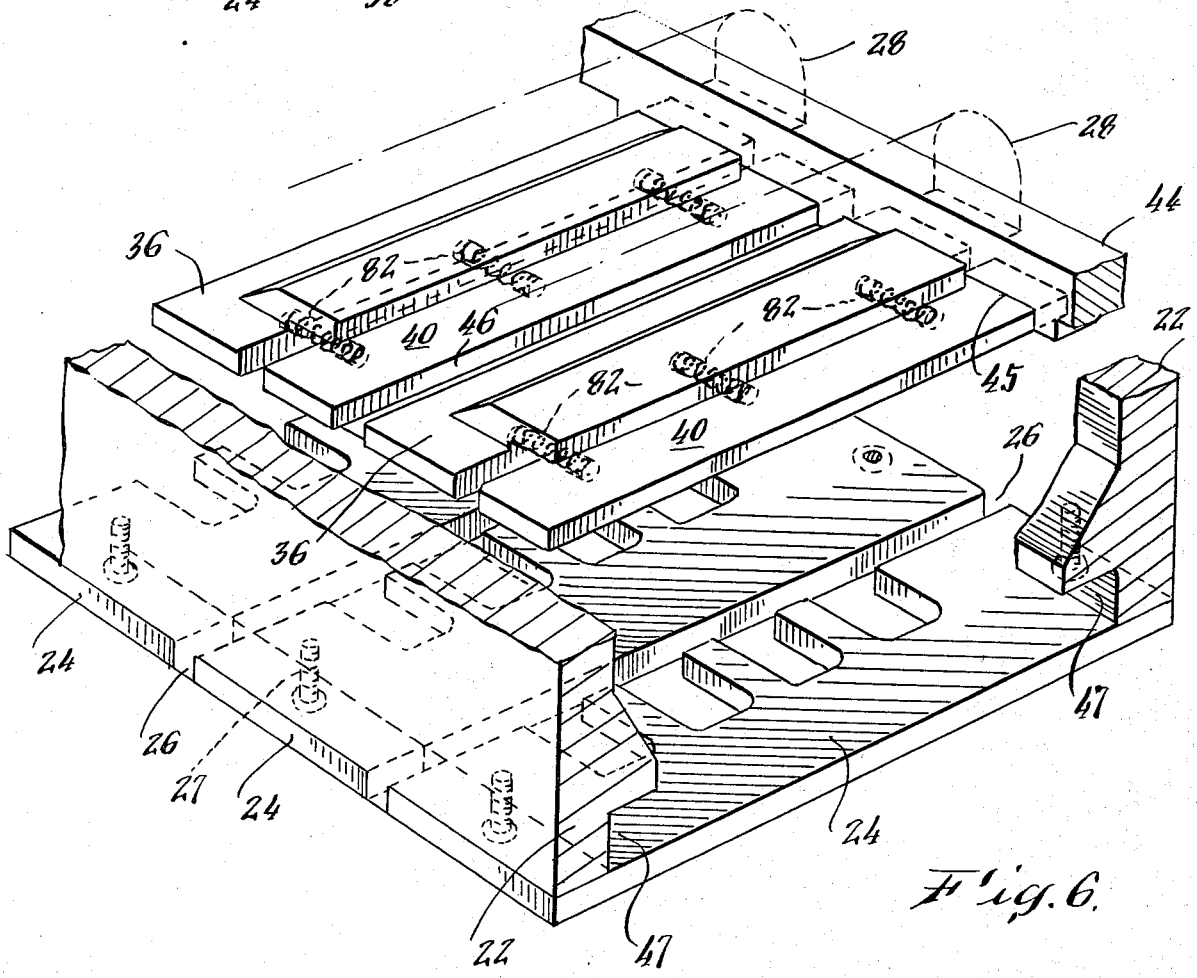
FIG. 6 is an enlarged exploded perspective view, partly in section, of the upper and lower plate assemblies of the stick dispensing apparatus illustrated in FIGS. 1 to 5.

Disposed between the front and rear panels or walls 14 and 16 are opposed inclined side walls 18 and 20 which with walls 14, 16 form a hopper to hold a plurality of sticks S. The side walls 18 and 20 converge towards each other from the top to the bottom of the apparatus 10 to guide a plurality of sticks S disposed between the enclosure defined by front and rear walls 14, 16 and side walls 18, 20 towards the center of the enclosure. Suspended from the front and rear walls 14, 16 by a hanger plate 22 connected to each of the walls, 14, 16, is a relatively fixed bottom plate 24 provided with a plurality of elongated stick dispensing openings 26 spaced at predetermined locations along its bottom or horizontal surface therealong. As shown in FIG. 6, the bottom plate 24 may be connected by screws 27 to the hanger plates 22.

Mounted above the fixed plate 24 are a plurality of stops 28. Stops 28 consist of a substantially semi-cylindrical dowel mounted by a bolt 30 to the opposed hanger plates 22. Each stop 28 has a horizontal surface 32 and a vertical interior surface or shoulder 34 spaced from a parallel, exterior abutment surface 37.

Disposed beneath the horizontal surface 32 of each stop 28 in abutment with the vertical interior shoulder 34 is the forward-most portion 36 of a two-piece section of a slidable and reciprocable upper plate assembly generally designated by the numeral 38. A rear-most portion 40 of each section of the slidable and reciprocable plate assembly 38 is connected to the forward-most portion by a plurality of coil springs received in facing apertures 82 in each portion 36, 40. Springs 42, normally bias the forward portion 36 and rear portion 40 of each section away from each other.

Normally, the forward-most portion 36 of each section of upper plate assembly 38 is in abutment with vertical shoulder 34 of a stop 28. A pair of reciprocably slidable bars 44 receive each two piece section of upper plate assembly 38 in a groove 45.

The bars 44 and connected portions 36 and 40 of each section rest on the interior surface of fixed lower plate 24. Bars 44 are received in slots 47 in opposed hanger plates 22.

The rear-most portion 40 of each of the sections of the upper plate assembly 38 is spaced from the adjacent forward portion 36 of a preceding section to define therebetween an elongated opening 46 which is adapted to be placed in registration with one of the openings 26 in the fixed lower plate 24 so that when in registration, an elongated stick S disposed between front and rear walls 14, 16 and inclined side walls 18, 20, can be dispensed therethrough to a mold placed beneath the apparatus 10.

Figure 3:
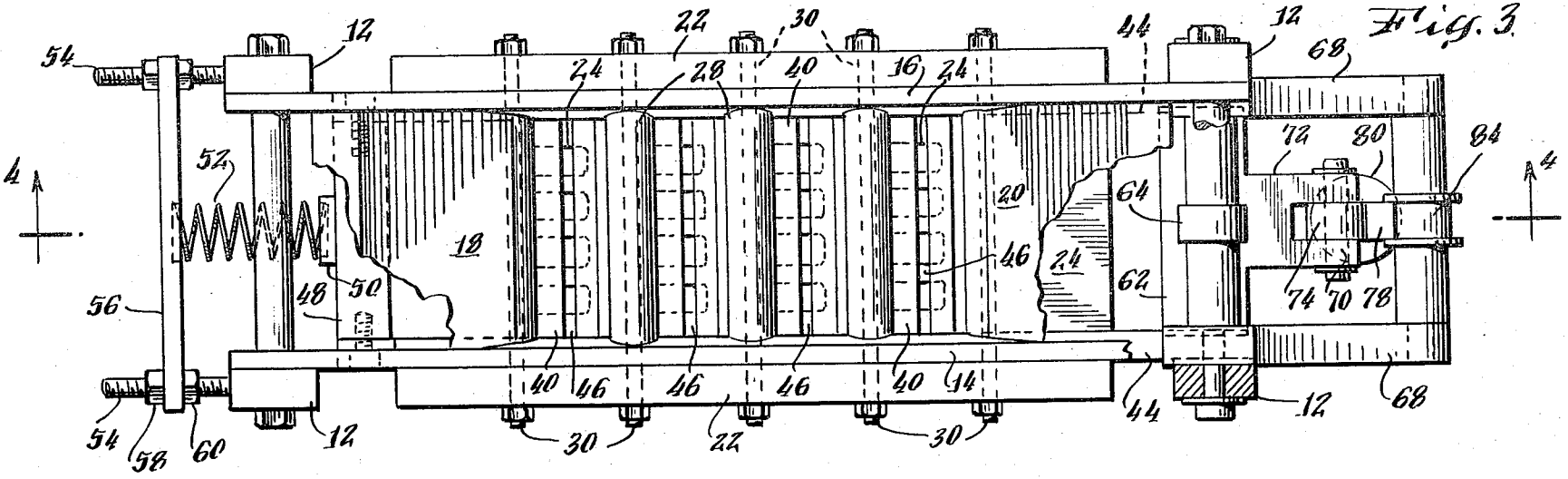
FIG. 3 is a top plan view of the stick dispensing apparatus of FIG. 1, partly broken away.
Figure 4:
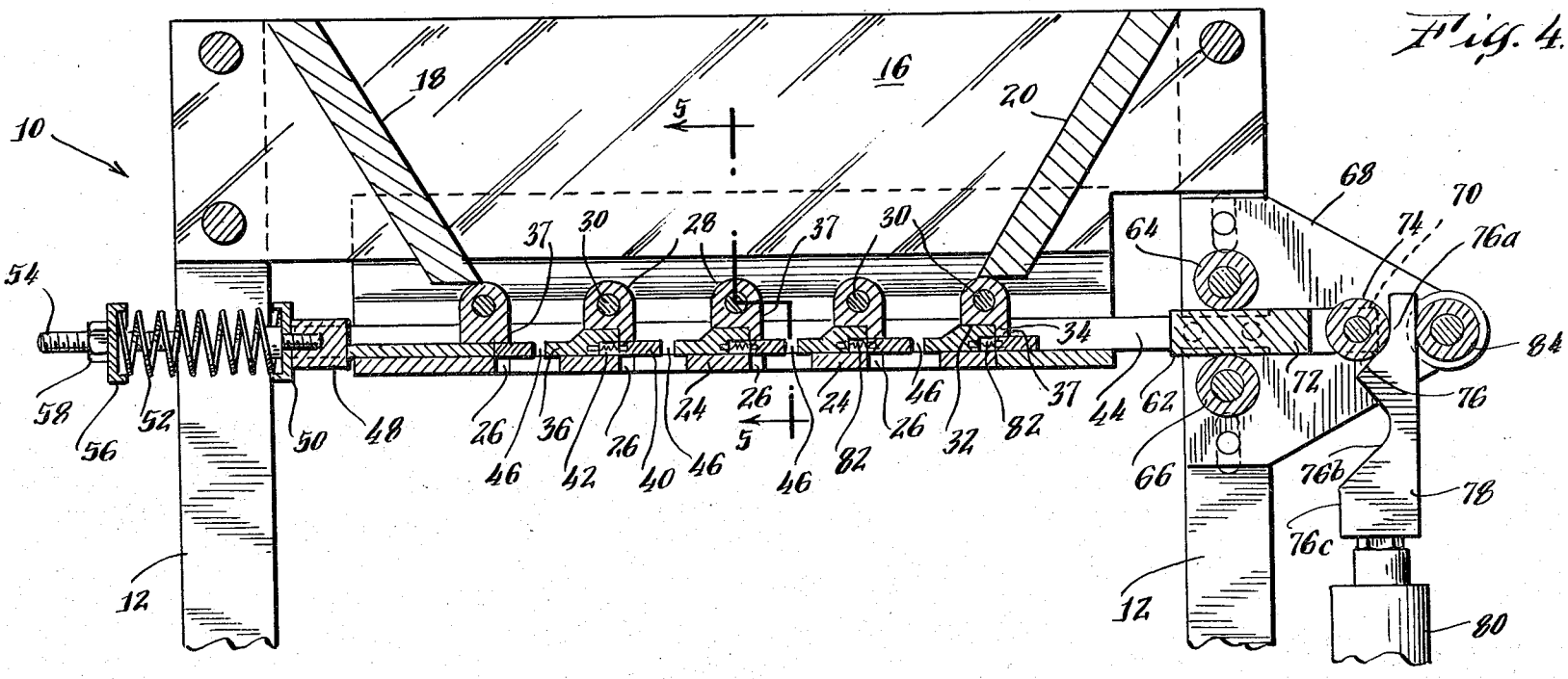
FIG. 4 is a cross-sectional view of the apparatus illustrated in FIG. 3, taken substantially along the plane indicated by line 4—4 of FIG. 3.
Figure 5:
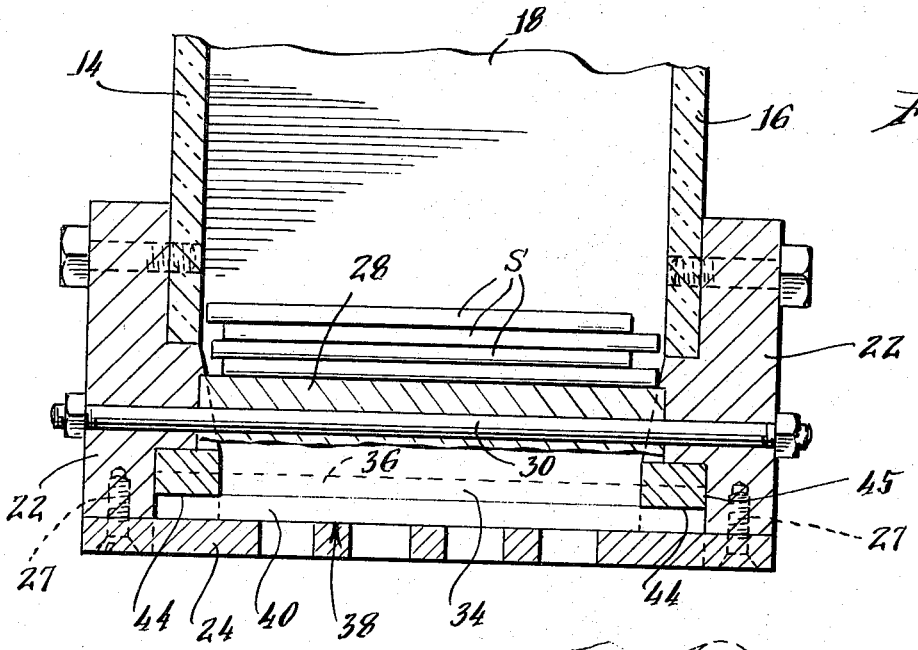
FIG. 5 is a cross-sectional view of the apparatus illustrated in FIG. 5, taken substantially along the plane indicated by line 5—5 of FIG. 4.

The elongated side bars 44 which are connected to each of the portions 36, 40 of each section of the upper plate assembly 38 are connected at one end by a cross beam 48 having a plate 50 providing a seat for a stiff coil spring 52 disposed between plate 50 and a second fixed cross plate 56 connected to the frame 12 by bolts 54. Plate 56 is adjustable along bolts 54 by loosening and tightening nuts 58 and 60 on opposite sides of plate 56. This adjusts the tension and compression of coil spring 52. Normally, spring 52 biases the slidable plate assembly 38 towards the right as viewed in FIGS. 3 and 4, keeping the openings 26 and 46 out of registration so as to preclude the dispensing of any sticks S from the apparatus 10.

At its opposite end, the bars 44 are connected to a cross beam 62 slidably disposed between an upper and lower roller 64 and 66 journalled between a pair of plates 68 on opposite sides of the frame 12. Beam 62 includes a pair of extension arms 70 and 72 between which is journalled a cam follower wheel 74. Cam follower wheel 74 is adapted to ride on a cam surface 76 cut in one side of a cam block 78 fixed to the upper end of a hydraulic or pneumatic cylinder 80 and disposed between wheel 74 and an idler wheel 84 journalled between plates 68.

Figure 7:
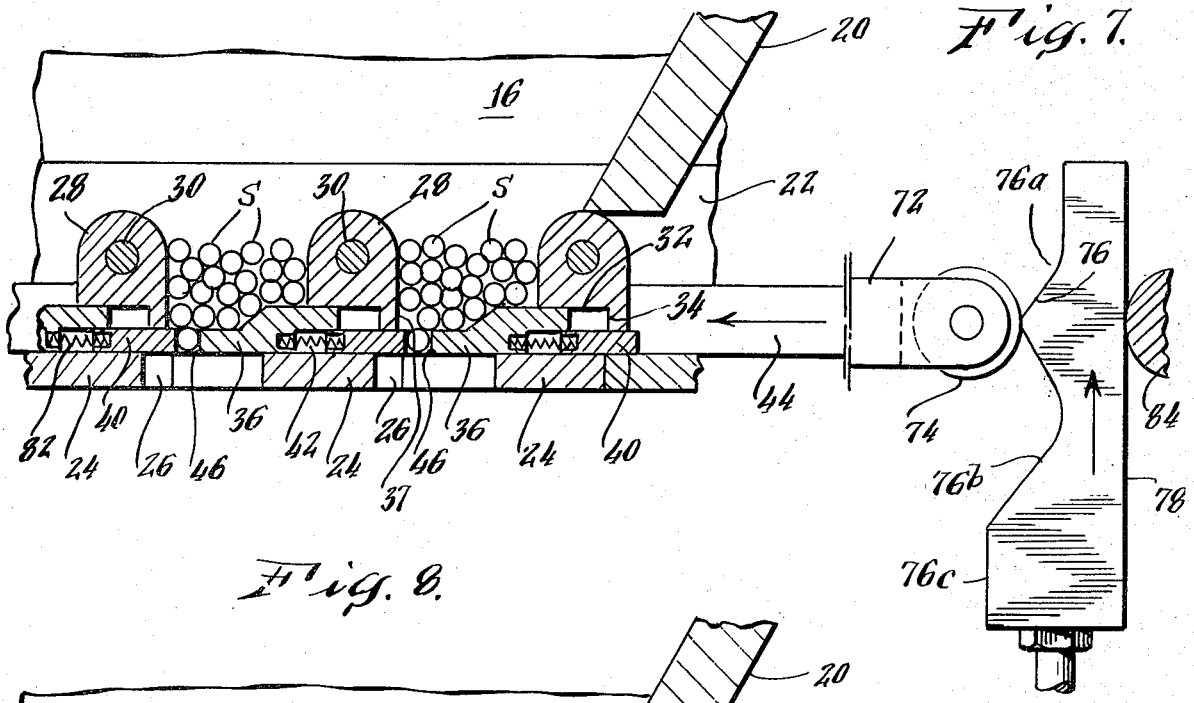
FIGS. 7 to 9, inclusive, are partial sectional and diagrammatic views illustrating the operation of the apparatus of FIGS. 1 to 5 to dispense a plurality of sticks simultaneously from the apparatus.
Figure 8:
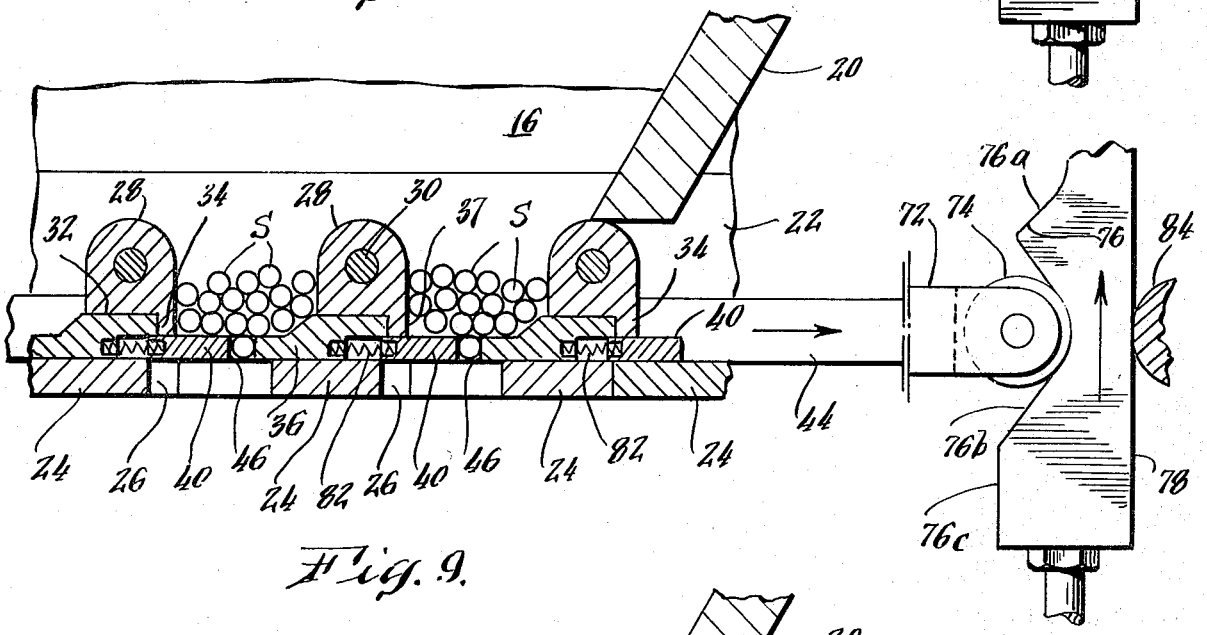
Figure 9:
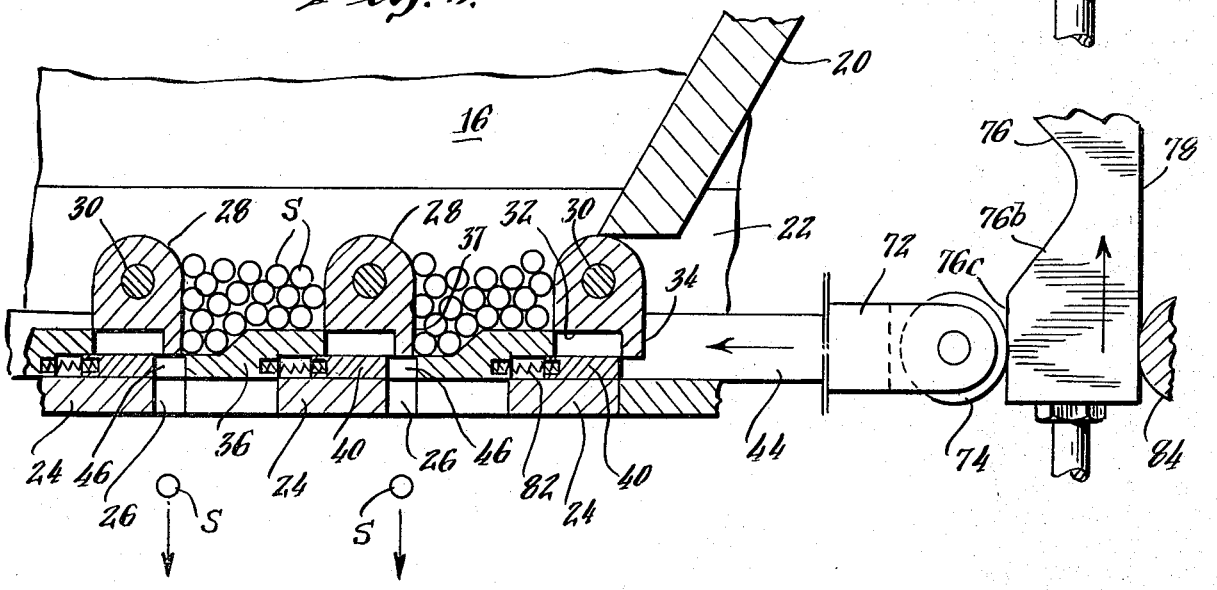

Upon raising of cam block 78 by cylinder 80, cam follower 74 will ride from cam surface **76*a* to cam surface 76*b* to cam surface 76*c*, as shown in FIGS 7 to 9, inclusive. The initial movement of cam wheel 74 from cam surface 76*a* to cam surface 76*b* causes bars 44 and upper plate assembly 38 to initially move to the left (FIG. 7) to agitate the sticks S seated on the plate assembly 38 between stops 28 and causes a stick S to drop into one of the slots 46. When the cam wheel 74 seats on cam surface 76*b* (FIG. 8), spring 52 moves the bars 44 and plate assembly 38 to the right completing the agitation movement and loading of a stick S in each slot 46. Continued upward movement of cam block 78 (FIG. 9) causes cam wheel follower 74 to ride on straight cam surface 76*c*, which is forward of surfaces 76*a* and 76*b*, pushing bars 44 and upper plate assembly 38 to the left against the bias of spring 52 a distance sufficient to register one of the openings 46 with an opening 26 in fixed plate 24 to simultaneously dispense a plurality of sticks S from apparatus 10 to a mold. The cam block 78** is then retracted and the cycle recommenced.

Exterior surface 37 of each stop 28 blocks all sticks S except for the one loaded within an adjacent opening 46 in upper plate assembly 38 from reaching the registering opening 26 in bottom plate 24, precluding more than one stick S from being dispensed at any one time through a pair of registered openings 46, 26. Each opening 26 is disposed beneath one of the stops 28.

Figure 10:
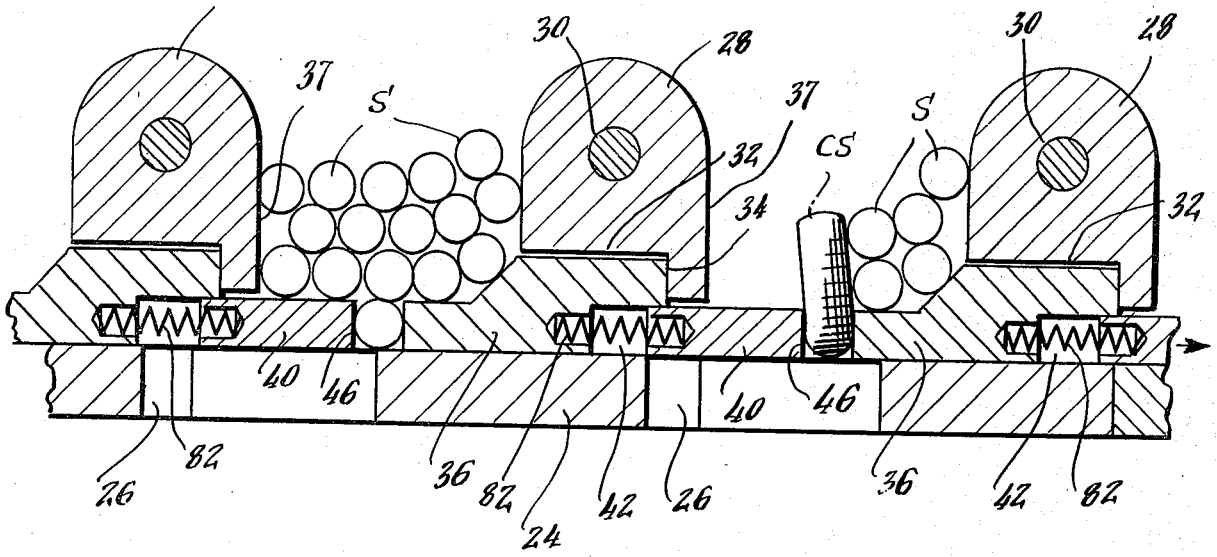
FIGS. 10 and 11 are enlarged views similar to FIGS. 8 and 9 respectively, illustrating the operation of the apparatus upon clogging or jamming of one of the dispensing openings of the apparatus.
Figure 11:
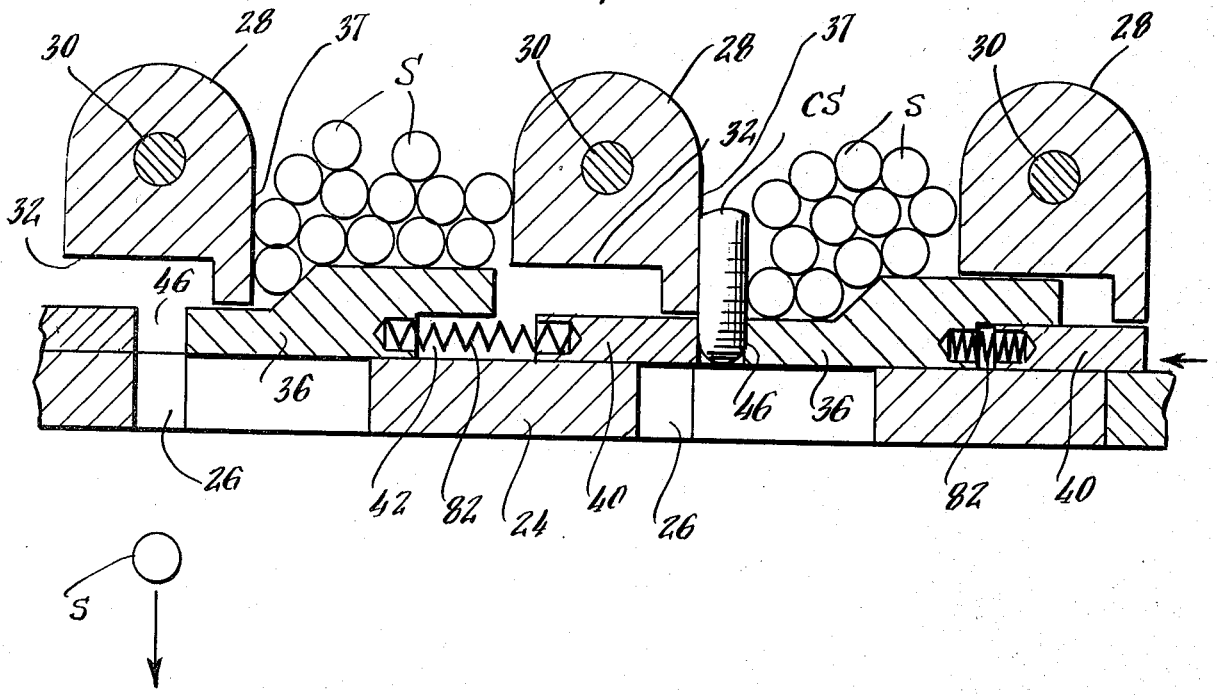

In the event that a stick becomes jammed or clogged in any of the openings 46, this does not preclude the apparatus 10 from operating during any one cycle or on subsequent cycles to dispense sticks S through the remaining openings of the apparatus 10. As shown in FIGS. 10 and 11, should an opening 46 become clogged or jammed with a stick CS, the clogged stick CS will be carried along by upper plate assembly 38 until it contacts and abuts exterior surface 37 of an adjacent stop 28 (FIG. 11). This will preclude further movement of the forward-most portion 36 of the section of upper plate assembly in contact with stick CS towards an adjacent opening 26 in bottom plate 24, but will enable the rear-most portion 40 of the same section to continue its movement in a forward direction or to the left as viewed in FIG. 11, compressing springs 42 between it and portion 40. This in turn, enables the side bars 44 to continue their forward travel without impairment, to register the remaining openings 46 with openings 26 in fixed bottom plate 24.

What is claimed as new is:

1. Apparatus for dispensing sticks at a plurality of predetermined locations comprising:

hopper means including a fixed bottom plate assembly having a plurality of elongated openings disposed at predetermined locations therealong, a reciprocable upper plate assembly slidably received on the upper surface of said fixed bottom plate assembly, said slidable and reciprocable upper plate assembly including a plurality of elongated openings adapted to be placed in registration with the openings in said fixed bottom plate assembly for dispensing a plurality of sticks disposed within said hopper through each pair of registered openings, said upper plate assembly including sections having first and second portions between each of the elongated openings therein which are movable relative to each other and to the first and second portions of the other sections, whereby upon one of said portions in each section meeting an obstruction placed in its path to movement, the preceding and succeeding portions in adjacent sections of said upper plate assembly will continue its movement enabling registration of at least certain ones of said openings in said upper plate assembly with certain ones of said openings in said bottom plate assembly, and means operatively connected to said upper plate assembly for reciprocably driving the same.

2. Apparatus in accordance with claim 1 wherein said reciprocable drive means includes:

a cam follower connected to said upper plate assembly, and cam means in contact with said cam follower for moving said cam follower and upper plate assembly in response to movement of said cam means.

3. Apparatus in accordance with claim 2 wherein said cam means is fixed to a fluid motor.

4. Apparatus in accordance with claim 2 wherein said cam means includes a cam surface for moving said cam follower first in a reciprocating horizontal direction to agitate the contents of said hopper and then, in a horizontal direction sufficient to cause registration of said openings in said upper and bottom plates in response to uni-directional vertical movement of said cam means.

5. Apparatus in accordance with claim 1 wherein said upper plate assembly includes:

a pair of reciprocating side bars having spaced grooves for receiving therein one of said relatively movable plate sections.

6. Apparatus in accordance with claim 5 wherein each of said side bars is connected at each end to a cross beam, each of said cross beams being connected to said reciprocable drive means, and said reciprocable drive means including a cam follower connected to one of said cross beams, cam means in rolling engagement with said cam follower for translating uni-directional vertical motion to reciprocating, horizontal movement of said side bars, and the other of said cross beams being connected to means for urging said side bars and cam follower against said cam means.

7. Apparatus in accordance with claim 1 wherein:

the relatively movable first and second portions of each section of said upper plate assembly are connected by at least one, compressible coil spring.

8. Apparatus in accordance with claim 6 wherein:

the relatively movable first and second portions of each section of said upper plate assembly are connected by at least one, compressible coil spring.

9. Apparatus in accordance with claim 6 including:

roller means above and below one of said cross beams for guiding the same during horizontal movement of said upper plate assembly.

10. Apparatus in accordance with claim 6 wherein said cam means includes a cam surface for moving said cam follower first in a reciprocating horizontal direction to agitate the contents of said hopper and then, in a horizontal direction sufficient to cause registration of said openings in said upper and bottom plates in response to uni-directional vertical movement of said cam means.

11. Apparatus in accordance with claim 10 wherein said cam means is fixed to a fluid motor.

12. Apparatus in accordance with claim 1 wherein said hopper means further includes:

a pair of opposed front and rear walls, and stop means between the front and rear walls of said hopper means having a first vertical surface for abutting one of the first portions of each section of said upper plate assembly and a second vertical surface disposed above but adjacent to the path of movement of said second portion of each section in said upper plate assembly.

13. Apparatus in accordance with claim 12 wherein each of said stop means has a horizontal surface above one of the openings in said bottom plate.

14. Apparatus in accordance with claim 6 wherein said hopper means further includes:

a pair of opposed front and rear walls and stop means between the front and rear walls of said hopper means having a first vertical surface for abutting one of the first portions of each section of said upper plate assembly and a second vertical surface disposed above but adjacent to the path of movement of said second portion of each section in said upper plate assembly.

15. Apparatus in accordance with claim 14, wherein each of said stop means has a horizontal surface above one of the openings in said fixed bottom plate.

* * * * *